United States Patent [19]

Smith et al.

[11] Patent Number: 4,594,948

[45] Date of Patent: Jun. 17, 1986

[54] LIQUID AND SOLID DUAL LADING RAILROAD CAR

[75] Inventors: Kenneth H. Smith, Smyrna; Walter J. Marulic, Dunwoody, both of Ga.

[73] Assignee: Thrall Car Manufacturing Company, Chicago Heights, Ill.

[21] Appl. No.: 646,976

[22] Filed: Sep. 4, 1984

[51] Int. Cl.[4] ..... B61D 5/06; B61D 7/00

[52] U.S. Cl. ..... 105/359; 105/248; 105/360

[58] Field of Search ..... 105/247, 248, 355, 360, 105/362, 358, 359, 357; 280/5 R; 220/DIG. 24; 296/15

[56] References Cited

U.S. PATENT DOCUMENTS

| | | | |
|---|---|---|---|
| 337,828 | 3/1886 | Gathright | 105/359 |
| 1,394,956 | 10/1921 | Weaver | 105/362 |
| 1,608,225 | 11/1926 | Mauran | 220/DIG. 24 |
| 1,630,868 | 5/1927 | Spence | 105/359 |
| 2,229,081 | 1/1941 | Hansen et al. | 105/357 |
| 2,323,458 | 7/1943 | Dunn | 105/359 |
| 2,558,648 | 6/1951 | Gausmann | 105/358 |
| 3,994,239 | 11/1976 | Baker et al. | 105/358 |
| 4,257,332 | 3/1981 | Sechrist | 105/362 |
| 4,352,331 | 10/1982 | Anderson et al. | 105/248 |

*Primary Examiner*—David A. Scherbel
*Assistant Examiner*—Dennis C. Rodgers
*Attorney, Agent, or Firm*—Marshall, O'Toole, Gerstein, Murray & Bicknell

[57] ABSTRACT

A dual lading railroad car which can carry solid, granular lading in hoppers at each end of the car and a liquid lading in a tank located in the center of the car between the hoppers. Only liquid lading can be carried in one direction and only solid, granular lading can be carried in a different or return direction, or both such ladings can be carried simultaneously in the same direction. Phosphate rock can be carried in the hoppers and molten sulfur in the tank. The exterior of the car looks substantially like a conventional covered hopper car since the tank is fully enclosed by the car walls and roof.

3 Claims, 12 Drawing Figures

LIQUID AND SOLID DUAL LADING RAILROAD CAR

This invention relates to railroad cars. More particularly, this invention is concerned with a multiple compartment car which permits alternate transportation of a liquid lading in one compartment in one direction with no solid lading being carried, and in the return, or some other, direction, a solid lading in a different compartment with the liquid lading compartment empty. However, the car can be used to carry liquid lading and solid lading in the compartments in one direction.

BACKGROUND OF THE INVENTION

After the transportation of freight by railroad from a place of origin to a delivery point or destination, it is all too common and necessary to return the railroad cars empty to the place of origin to be loaded again. In some instances the cars must be returned empty because there is no return load of any kind to be carried. At other times return loads which are available cannot be shipped in the type of railroad cars to be returned to the point of origin. For example, coal cars would not be suitable for carrying a return shipment of a liquid product. Regardless of the reason, moving empty cars is costly, in part because of the absence of a pay load, but also because of the labor and fuel costs involved and the wear and tear on the equipment.

With respect to North America, liquid lading is at times to be transported by railroad from a point of origin to a destination which has a solid commodity, in the form of a particulate or granular material, which is to be transported back to, or reasonably close to, the point of origin of the liquid lading. If cars adapted to carry only liquid or solid lading are used, it is necessary for the return trip in either direction to move the cars empty with the disadvantages already described.

Various solutions to the described problem have been advanced in both the railroad car and highway trailer industries. See, for example, Dunn U.S. Pat. No. 2,323,458; Henderson U.S. Pat. No. 4,403,783; Rollins U.S. Pat. No. 3,495,548; and Freudman et al U.S. Pat. No. 3,583,330. Even though these patents propose various solutions, a need exists for a more improved railroad car which can carry alternate liquid-solid lading in either direction, especially a car which can alternately carry the maximum load of heavy solid lading, or a maximum load of liquid lading, permitted by railroad standards. Additionally, a need exists for a multiple compartment railroad car which can carry simultaneously both solid lading and liquid lading in separate compartments, regardless of whether the goods originate at, or are shipped to, a common area.

SUMMARY OF THE INVENTION

According to the invention a railroad car is provided comprising a car body supported at each end by a truck; the car body including a pair of spaced apart upwardly extending longitudinal side walls; a roof supported by the side walls; a hopper at each end of the car for carrying solid flowable lading; each hopper being defined by a portion of each side wall and roof, and a pair of spaced apart hopper end walls extending laterally between the side walls; a hopper inlet access hatch opening in the roof for each hopper and a hopper discharge opening at the bottom of each hopper with door means to close the opening; an elongated tank horizontally located between the hoppers and roof; means mounting and supporting the tank between the car body side walls and roof with a bottom area of the tank secured with respect to the car body whereby the positional arrangement of the tank bottom area to the car body is maintained upon expansion or contraction of the tank with temperature change; and means to fill the tank with liquid through the roof and means for removing liquid from the tank.

The side walls and roof run continuously for substantially the entire length of the car and thus provide strength with light weight. In addition to defining the hopper side walls and roof, the car body side walls and roof surround or encapsulate the liquid lading tank and protect it from the environment. This is an important consideration when the tank is thermally insulated because the insulation is protected against rain and snow as well as mechanical damage during loading and unloading as well as in transit. Car maintenance is thus minimized. Additionally, in case the car is derailed, the continuous side walls and roof, as well as the end hoppers, provide substantial protection to the tank, thus greatly increasing the likelihood that the tank will not rupture and release the liquid lading.

Desirably, the tank is mounted and supported so that buff and draft squeeze loads are not applied to the tank. However, impact accelerations will create loads in the tank.

The means mounting and supporting the tank can include a cradle at about each end of the tank.

Each cradle can include support means extending to the car body side walls. Alternatively, by locating each tank end adjacent a hopper end wall, each cradle can be supported by means attached to the adjacent hopper end wall. Also, when the car has a center sill, the cradles can be connected to the center sill.

Instead of a center sill the railroad car can have a stub center sill at each end; a side sill along the bottom portion of each car body side wall; a shear plate interconnecting each stub sill and adjacent side sill portions; and a shear plate, to which the said tank bottom area is fixedly secured, joined to the side sills.

More specifically, a railroad car is provided comprising a car body having a center sill supported at each end by a truck; a pair of spaced apart upwardly extending longitudinal side walls connected to the center sill by body bolster means; a roof supported by the side walls; a hopper at each end of the car for carrying solid flowable lading; each hopper being defined by a portion of each side wall and roof, and a pair of spaced apart hopper end walls extending laterally between the side walls; a hopper inlet access hatch opening in the roof for each hopper and a hopper discharge opening at the bottom of each hopper with door means to close the opening; an elongated tank horizontally located between the hoppers, roof and center sill; means mounting and supporting the tank on the center sill with a bottom area of the tank between the tank ends fixedly secured to the center sill whereby the positional arrangement of the tank bottom area to the center sill is maintained upon expansion or contraction of the tank with temperature change; and means to fill the tank with liquid through the roof and means for removing liquid from the tank.

The means mounting and supporting the tank on the center sill can comprise a plurality of spaced apart cradles, on the center sill, in which the tank nests, said cradles including extensions joined to the side walls.

The longitudinal center of the tank can be located above the longitudinal center of the center sill. The tank bottom area at the longitudinal center is desirably fixedly secured to the center sill longitudinal center area so that said positional arrangement is maintained with temperature induced longitudinal contraction or expansion of the tank. The temperature induced longitudinal contraction and expansion of the tank can be accommodated by the cradles.

The hoppers can be essentially identical. Each tank end can be adjacent a hopper end wall, which may be substantially vertical. Also the hopper end wall closest to the car end can be sloped, such as at the bottom.

When the tank is to carry a liquid at an elevated temperature, it is desirably externally insulated to retard heat loss from the tank. Also, to reliquefy the lading if it cools and solidifies, the tank can have means to heat the liquid lading.

The hoppers can be sized to carry a specific solid lading therein which can equal the maximum load bearing capacity of the car with the tank empty. Similarly, the tank can be sized to carry a specific liquid lading therein which can equal the maximum load bearing capacity of the car with the hoppers empty. Additionally, the hoppers and the tank can be sized so that the combined load when the hoppers and tank are full equal the maximum load bearing capacity of the car.

A car according to the invention can have an insulated tank for carrying molten sulfur in one direction with the hoppers empty. In a return, or different direction, the hoppers can be loaded with phosphate rock and the tank can be empty. Of course, by proper sizing of the hoppers and tank, both such ladings can be carried simultaneously in one direction.

DETAILED DESCRIPTION OF THE DRAWINGS

Figure 1:
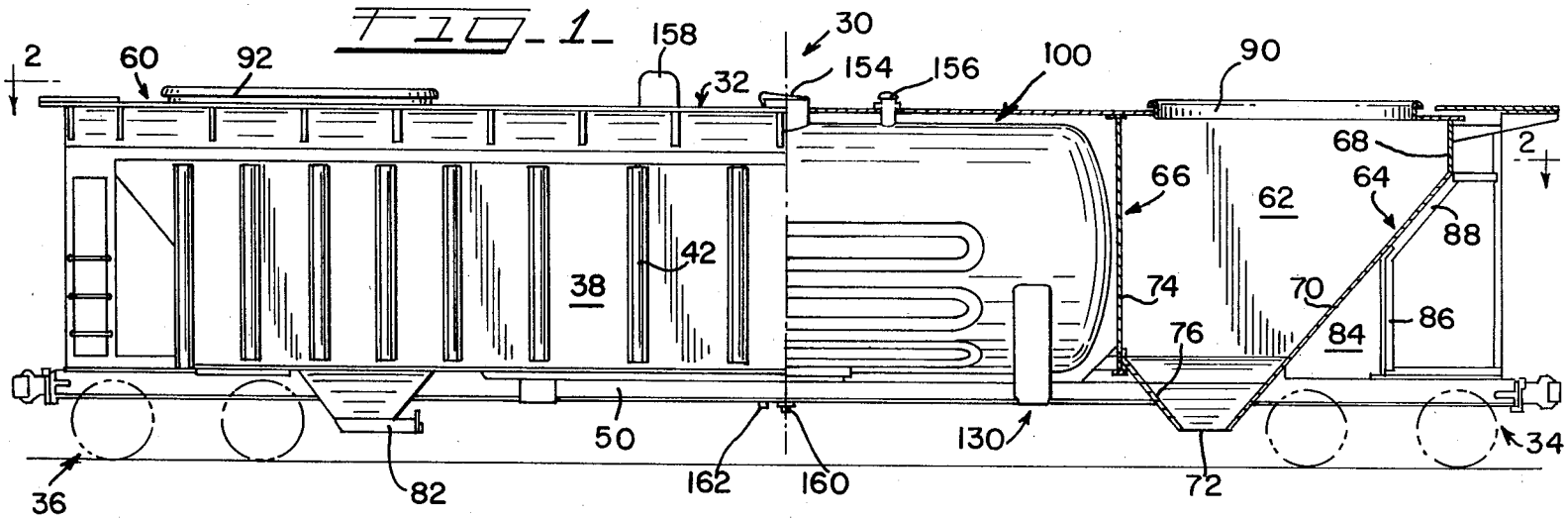
FIG. 1 is a side elevational view, partially broken away and in section, of one embodiment of a railroad car, having a center sill, according to the invention.
Figure 2:
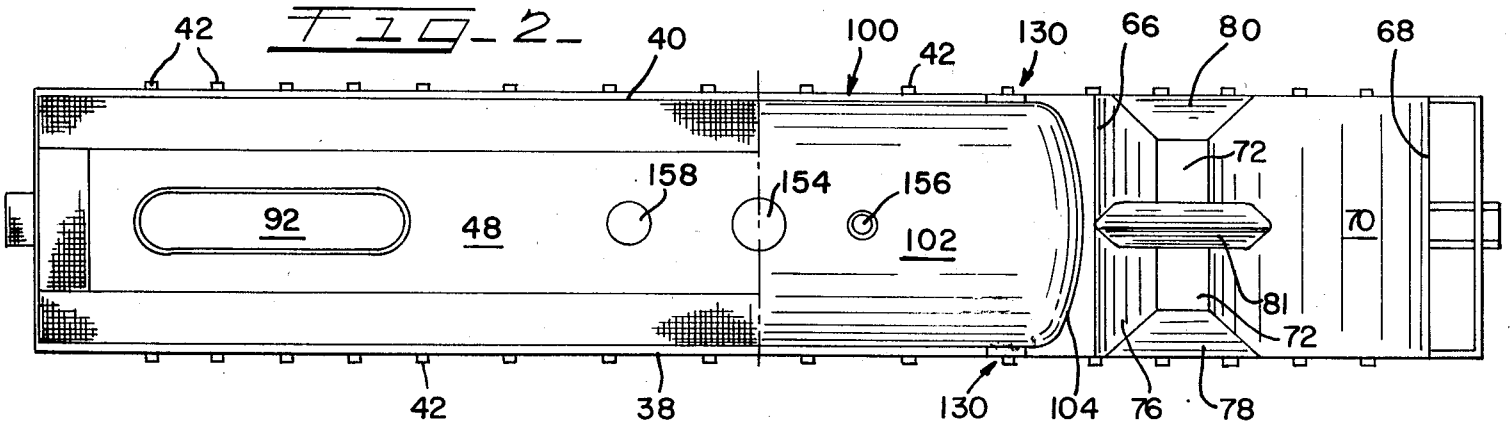
FIG. 2 is a sectional view taken along the line 2—2 of FIG. 1.

To the extent it is reasonable and practical, the same or similar parts or elements which appear in the various views of the drawings will be identified by the same numbers.

FIGS. 1 to 5 taken together illustrate one embodiment of multiple compartment plural lading carrying railroad car provided by the invention. The railroad car 30 broadly comprises car body 32 and wheel trucks 34, 36 at each end. The car body 32 includes a pair of vertical identical side walls 38, 40 which are stiffened or reinforced by vertical spaced apart channel members 42. Each side wall 38, 40 has a lower longitudinal chord or side sill 44 and an upper longitudinal chord or side plate 46. Roof 48 is supported on the top of the side walls 38, 40.

A center sill 50, which is part of the car body, extends for the length of the car. A body bolster, not shown, is joined near each end of the center sill in such a manner as to cooperate with the truck bolster of each truck to support the car. The ends of the body bolster are joined to lower chords 44. Additionally, a horizontal shear plate, not shown, can extend across the top of the body bolster and the center sill and be joined to the lower chords 44.

Figure 4:
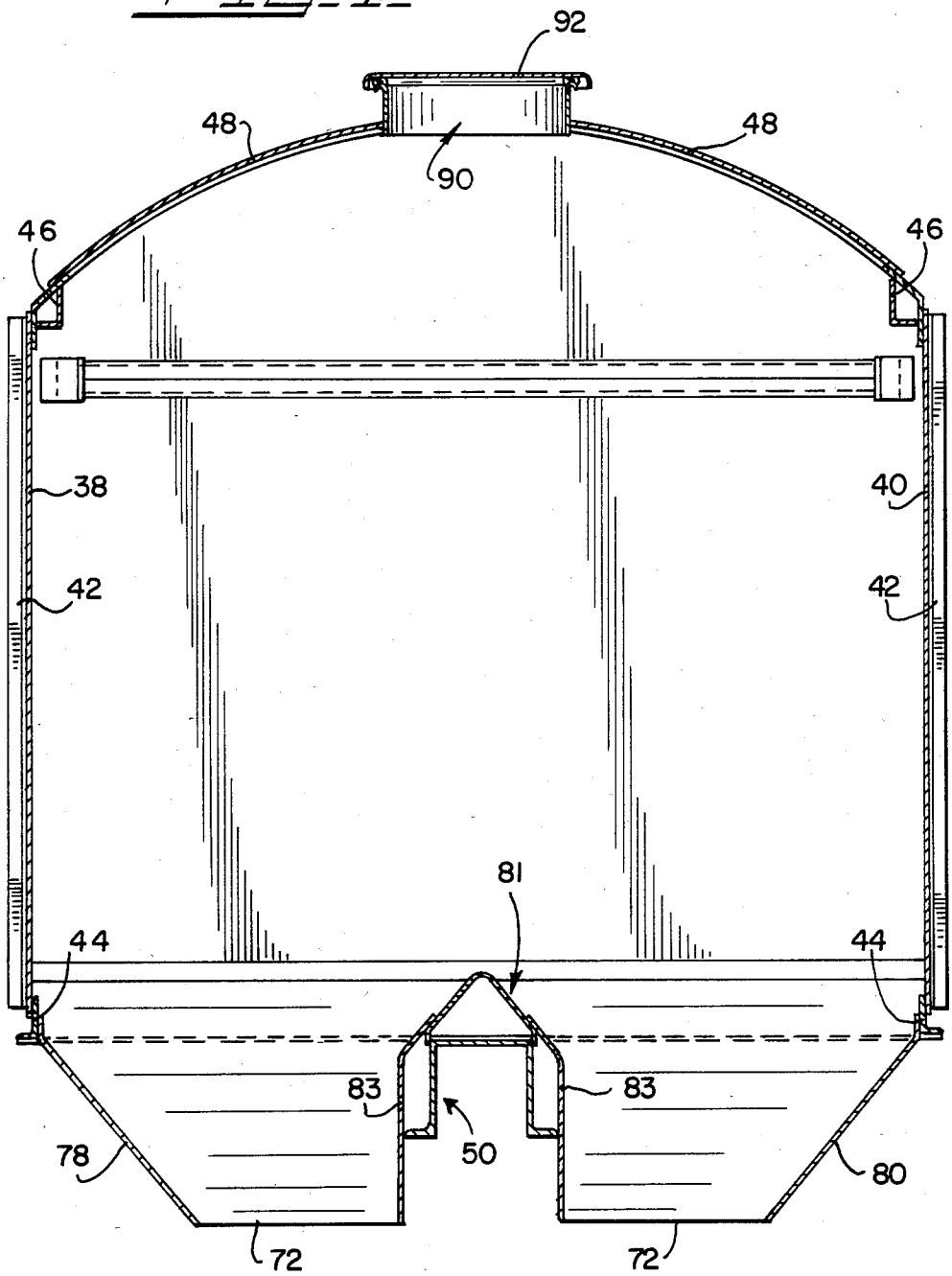
FIG. 4 is a sectional view taken along the line 4—4 of FIG. 3.

Each end of the car body 32 includes identical hoppers 60, 62 for carrying solid flowable lading, such as phosphate rock. Each hopper is defined largely by portions of side walls 38, 40, roof 48 and end walls 64, 66 which extend between the side walls up to the roof. End wall 64 includes an upper vertical section 68 and a sloped section 70 which terminates at the bottom in outlet 72. Similarly, hopper end wall 66 has a vertical section 74 and a lower sloped section 76 which terminates in outlet 72. The lower end of each hopper 60, 62 has inwardly sloping sheets 78, 80 which extend downwardly from side walls 38, 42 respectively and terminate in outlet 72. To keep solid lading out of contact with the center sill 50, it is covered by peaked member 81 to which sheet members 83 are connected on each side of the center sill (FIG. 4). Gate 82 (FIG. 1) is positioned at the bottom of each hopper to close opening 72 when desired.

The hopper end wall 64 is externally braced by vertical sheets 84 and braces 86 and 88.

An access or hatch opening 90 (FIG. 1) is located in the car roof 48 to provide separate access to each hopper 60, 62. An access opening hatch cover 92 is mounted on the roof to removably cover the access opening 90.

Figure 6:
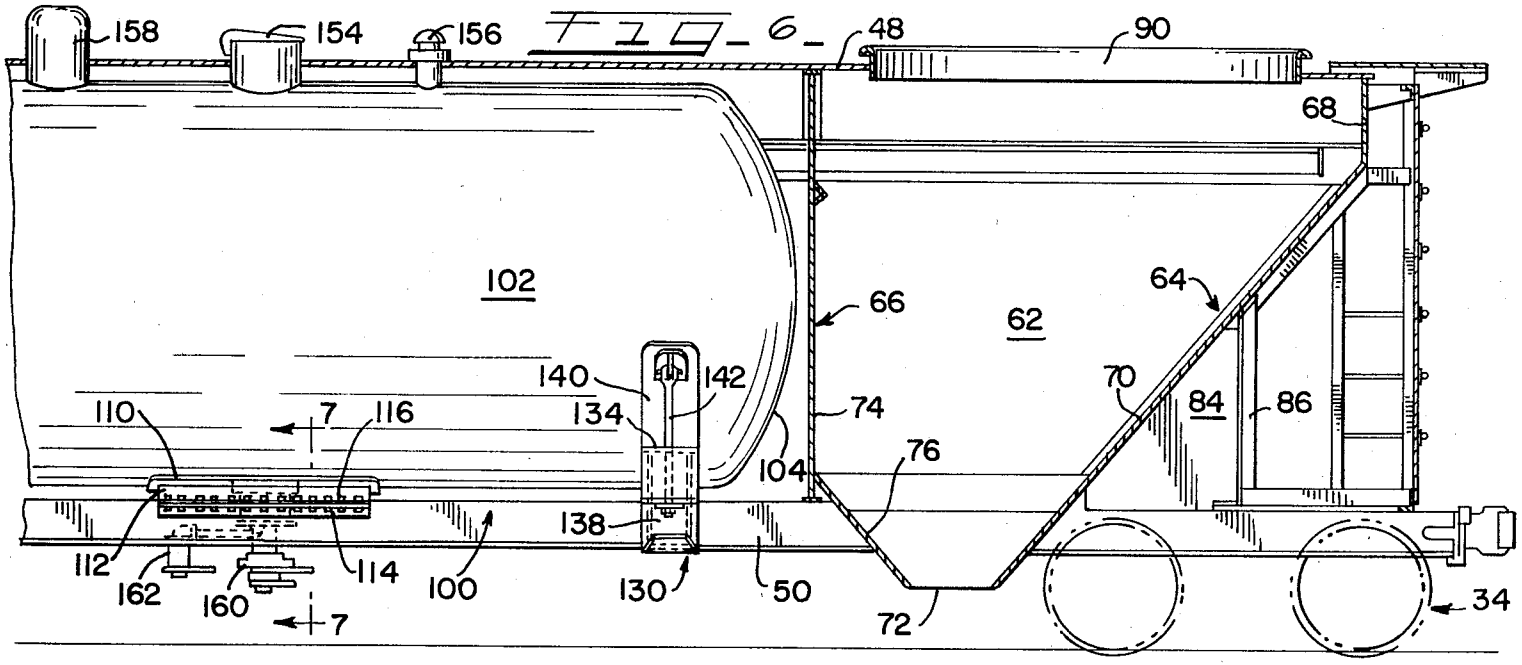
FIG. 6 is a side elevational view, partially broken away and in section, of the railroad car shown in FIGS. 1 to 5 and shows the tank central portion supported on and secured to the center sill.
Figure 7:
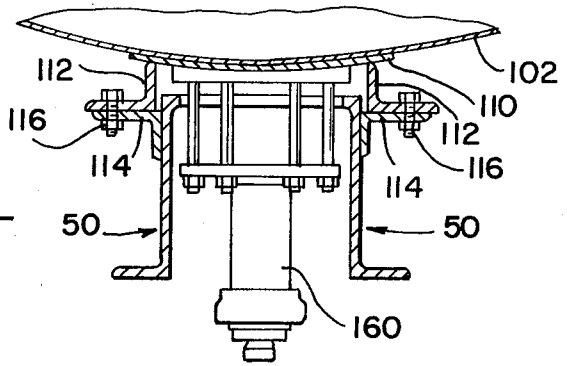
FIG. 7 is a sectional view taken along the line 7—7 of FIG. 6.

Located between the hoppers 60, 62, roof 32 and center sill 50 is liquid lading carrying tank 100, in this case designed to carry molten sulfur. The tank comprises a horizontal cylindrical circular shell 102 having convex ends 104 located close to hopper end walls 66. As shown in FIGS. 6 and 7, the longitudinal and lateral centers of the tank 100 are in perpendicular alignment with the longitudinal and lateral centers of the center sill 50. The central bottom area of the shell 102 has a reinforcing pad 110 secured to it. A pair of spaced apart parallel longitudinal angle members 112 extend downward from pad 110 and mate with a pair of angle members 114 mounted on the center sill. The mating pairs of angle members 112, 114 are connected together by bolts 116. The described tank mounting arrangement keeps the central bottom area of the tank in substantially constant positional arrangement with respect to the car body center sill during expansion or contraction of the tank with temperature change, such as when empty or filled with molten sulfur.

The ends of tank 100 are supported on identical saddles 130 equally spaced from the center of the tank. Each saddle 130 comprises a curved saddle plate 132 which ends in horizontal arms 134. Plate 132 and arms 134 are joined to vertical web plate 136, the inner ends of which are joined to center sill 50. The bottom of web plate 136 is stiffened by plates 138 and plates 140. The outer ends of saddle 130 are connected to the car side walls 38, 40 and lower chords 44.

Figure 3:
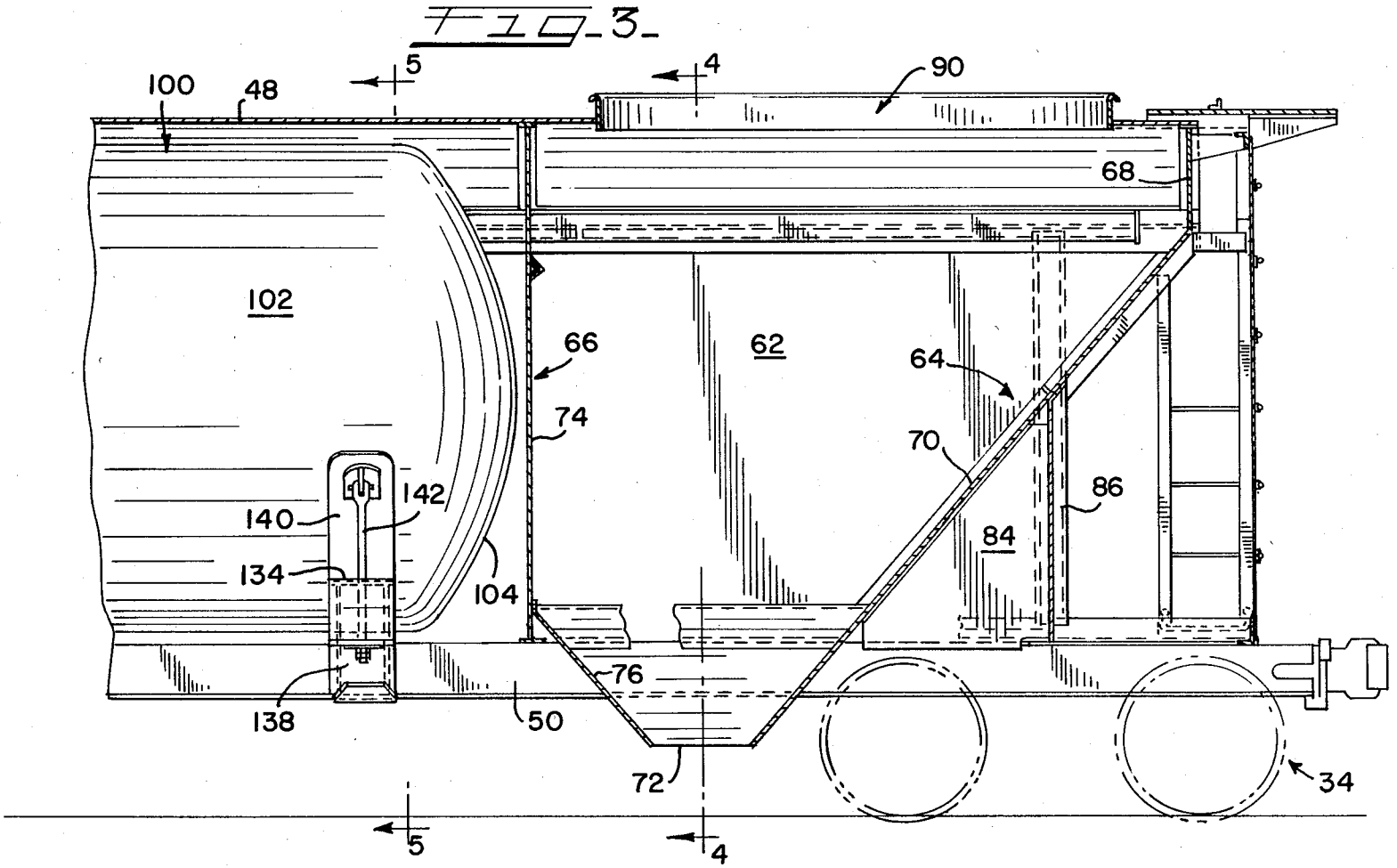
FIG. 3 is a partial vertical sectional view of one end of the car shown in FIGS. 1 and 2.
Figure 5:
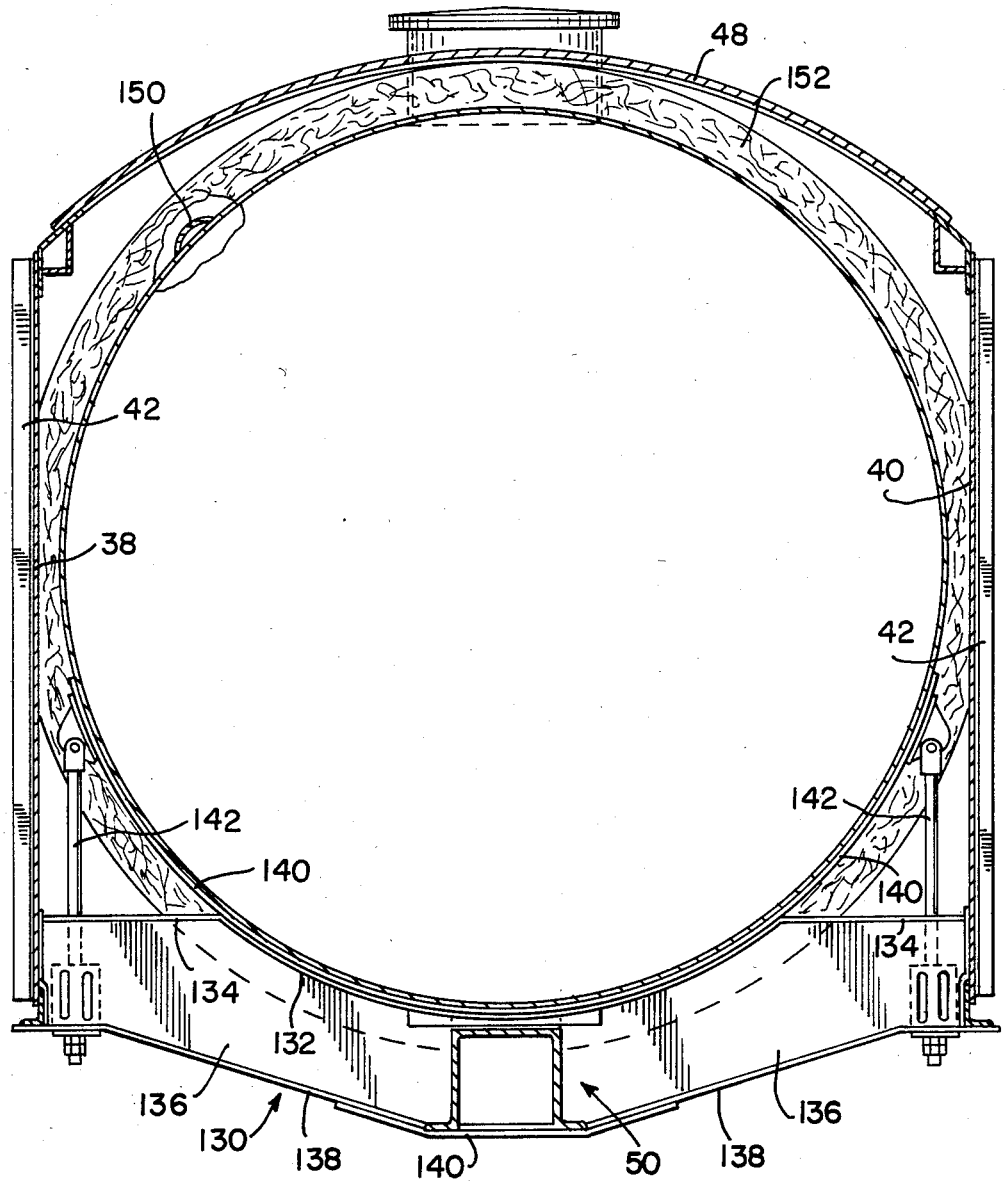
FIG. 5 is a sectional view taken along the line 5—5 of FIG. 3.

The tank shell 102 is provided with an exterior reinforcing plate 140 which nests in and is supported by saddle 130 (FIGS. 3 and 5). A pair of tank holddown bolts 142 are pivotally connected to the tank at the upper ends of plate 140 and at their lower ends to the outer ends of saddle 130 (FIG. 5).

By having the tank-supporting saddles connected to the side walls and side sills, loads applied by rocking of the tank are readily transferred to and absorbed or accepted by the car body side walls.

It is also significant that the tank constitutes a separate structure and does not share in common any structural parts, such as tank ends or walls, with the hopper ends, walls or roof, or other parts of the car body. Any failure of any other part of the car body, thus, will not directly affect the tank integrity.

When tank 100 is intended to carry a hot liquid lading, such as molten sulfur, it can be provided with an exterior heater coil system 150 through which a hot fluid, such as steam, can be circulated periodically or continuously by inlet/outlet 162. For efficient transport of a hot liquid lading the tank 100 is desirably covered with a suitable layer of thermal insulation 152 (FIG. 5).

The top of tank 100 is provided with a tank manway access and filling port 154, pressure relief valve 156 and vacuum relief valve 158. Outlet valve 160 is provided at the bottom of the tank for withdrawing liquid lading.

Figure 8:
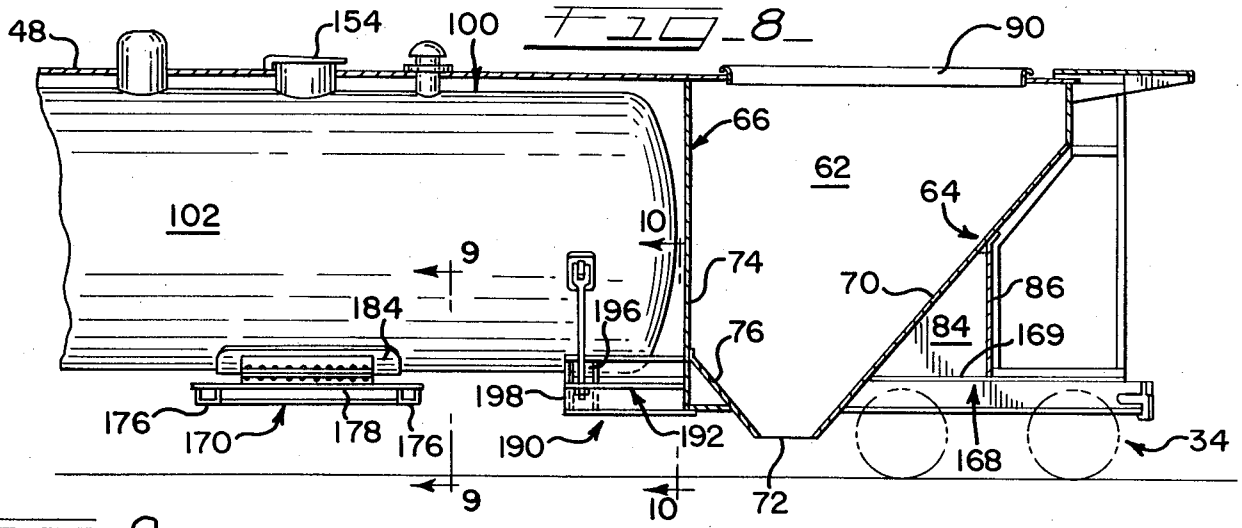
FIG. 8 is a side elevational view, partially broken away and in section, of a second embodiment of railroad car according to the invention which employs stub center sills at the end of the car.
Figure 10:
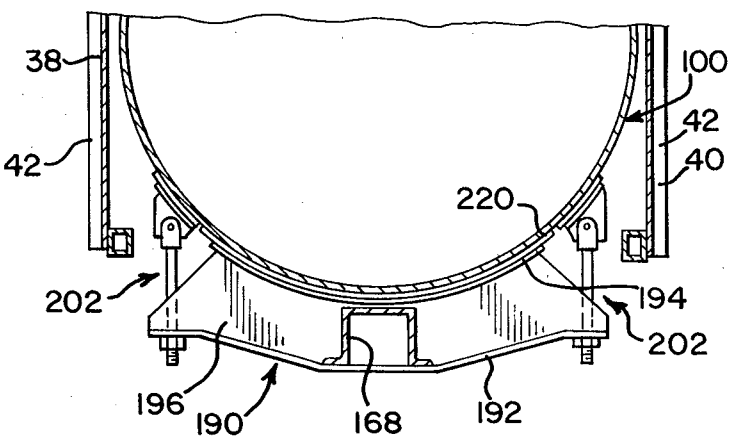
FIG. 10 is a sectional view taken along the line 10—10 of FIG. 8.
Figure 9:
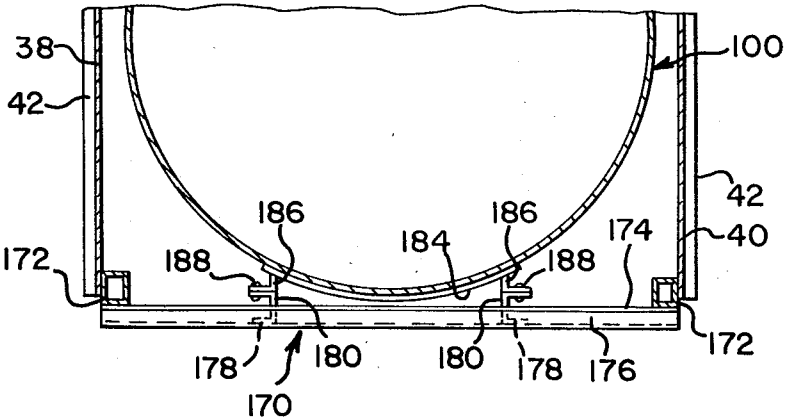
FIG. 9 is a sectional view taken along the line 9—9 of FIG. 8.

FIGS. 8 to 10 illustrate a second embodiment of the invention in which the railroad car has stub center sills 168 at each end. Each stub center sill 168 extends from beneath the adjacent tank end to the car end. A shear plate 169 extends between the side sills 172 over that portion of stub center sill 168 located over the wheel truck 34. In this embodiment, the central portion of tank 102 is supported in a fixed or stationary manner by a structure 170 which extends to lower side sills 172. Structure 170 includes a horizontal shear plate 174 which is stiffened by lateral channel members 176 and spaced apart angle members 178 joined to the lower surface of the shear plate. Shear plate 174 is joined at its opposing longitudinal edges to the two side sills 172. A pair of spaced apart parallel angles 180 are joined to the top of shear plate 174. The bottom of tank shell 102 has a reinforcing pad 184 secured to it. A pair of spaced apart parallel longitudinal angle members 186 extend downward from pad 184 and mate with the pair of angle members 180. The mating pairs of angle members 180, 186 are connected together by bolts 188. The described tank mounting arrangement keeps the central bottom area of the tank 100 in substantially constant positional arrangement with respect to the car body during expansion or contraction of the tank.

The ends of tank 100 are supported on identical saddles 190 which are joined to hopper end plate 66 (FIGS. 8 to 10). Lower plate 192 is joined at one end to hopper end plate 66 as is top curved plate 194. A pair of spaced apart vertical webs 196, 198 extend between and are joined to plates 190 and 194. The end of stub center sill 168 is connected to web plate 196. However, the stub center sill 168 can be made longer and terminate anywhere in the distance from plate 70 to vertical web 196. A pad 200 is joined to the lower portion of tank 100 so that it nests with curved plate 194 in a saddle-like arrangement. A pair of tank holddown bolts 202 are pivotally connected to the tank 100 and to the plate 192 (FIG. 10).

The saddle 190 described above can also be used in the first embodiment of railroad car illustrated by FIGS. 1 to 7 in place of the saddles 130. Instead of joining each of the saddles 190 to a stub center sill, or secondary structure built off the hopper end wall 66 and cross ridge elements, it can be joined to a center sill 50 extending for substantially the full length of the car.

Figure 11:
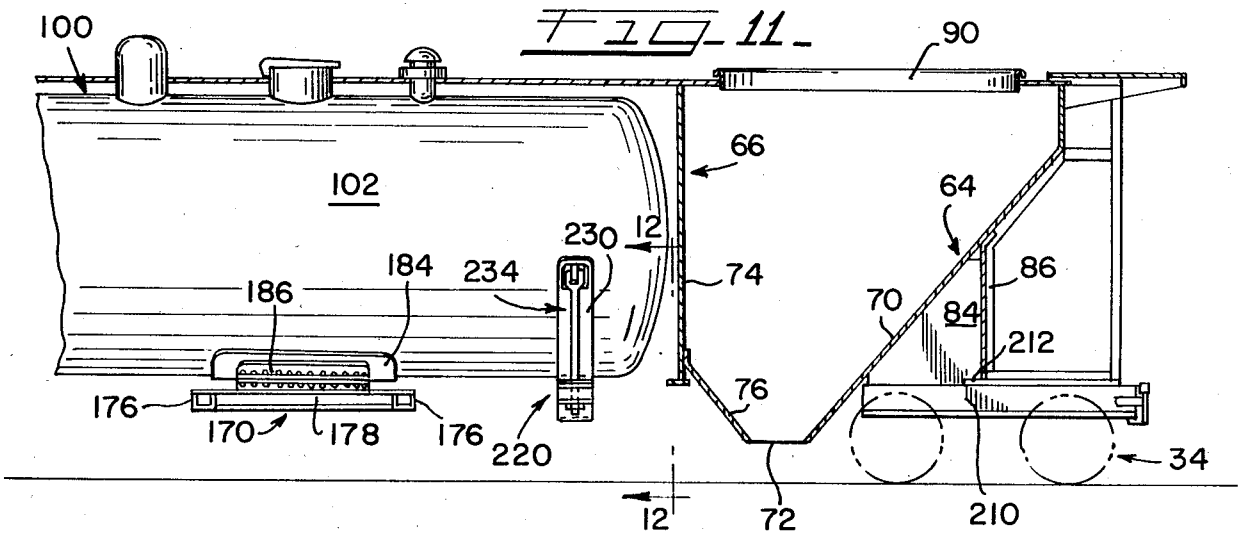
FIG. 11 is similar to FIG. 8 but shows the tank ends supported by the lower side sills.
Figure 12:
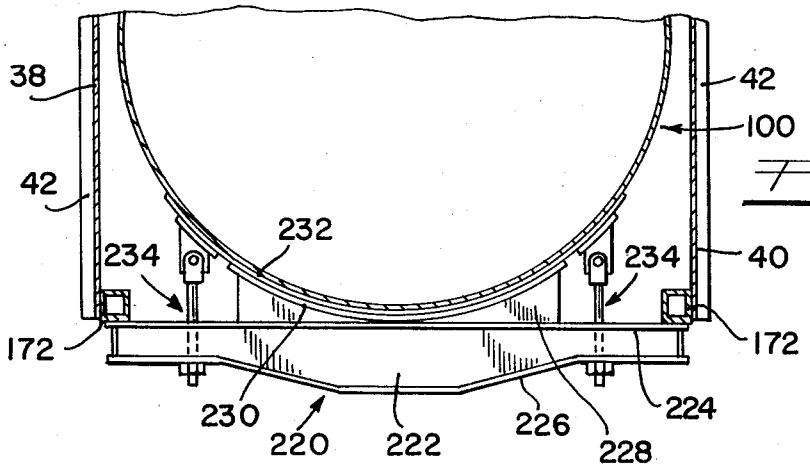
FIG. 12 is a sectional view taken along the line 12—12 of FIG. 11.

A third embodiment of railroad car is illustrated by FIGS. 11 and 12. The car shown in these figures has a stub center sill 210 at each end. Each stub center sill 210 extends from the adjoining car end to the hopper end wall 64. A shear plate 212 extends between and is joined to side sills 172. The shear plate extends over and is joined to the stub center sill 212.

The central lower portion of the tank 100 shown in FIGS. 11 and 12 is supported by a structure 170 previously described in conjunction with FIGS. 8 to 10.

A combination crossbearer-saddle structure 220 supports each end of tank 100. Crossbearer element 220 is fabricated by joining vertical web 222 to top and bottom horizontal plates 224 and 226. The top plate 224 is joined at its ends to each side sill 172. Vertical plate 228 extends upwards from plate 224 and supports curved plate 230. The bottom of tank 100 is provided with a reinforcing plate 232 which nests in curved plate 230 in a saddle-like arrangement. A pair of holddown bolts 234 are pivotally joined at their upper ends to the tank. The lower ends of bolts 234 extend into crossbearer 220 and are joined thereto by a nut or other fastener. This tank supporting structure also permits the tank to expand and contract as previously described above.

It should be understood that the tank in the embodiments illustrated by FIGS. 8 to 12 can be externally insulated if desired. Additionally, the tank can be provided with a coil system 150, as previously described, when a product is to be transported hot or if heat is needed to facilitate removal of the tank lading.

The foregoing detailed description has been given for clearness of understanding only, and no unnecessary limitations should be understood therefrom, as modifications will be obvious to those skilled in the art.

What is claimed is:

1. A railroad comprising:

a car body supported at each end by a truck;

the car body having a stub center still at each end;

the car body including a pair of spaced apart upwardly extending longitudinal side wall;

a side still along the bottom portion of each car body side wall;

a shear plate interconnecting each stub sill and adjacent side still portions;

a roof supported by the side walls;

a hopper at each end of the car for carrying solid flowable lading;

each hopper being defined by a portion of each side wall and roof, and a pair of spaced apart hopper end walls extending laterally between the side walls;

a hopper inlet across hatch opening in the roof for each hopper and a hopper discharge opening at the bottom of each hopper with door means to close the opening;

an elongated tank horizontally located between the hoppers and roof;

means mounting and supporting the tank between the car body side walls and roof with a bottom area of the tank fixedly secured with respect to the car body whereby the positional arrangement of the tank bottom area to the car body is maintained upon expansion of contraction of the tank with temperature change;

a shear plate to which the said tank bottom area is fixedly secured, joined to the side sills; and means to fill the tank with liquid through the roof and means for removing liquid from the tank.

2. A railroad car according to claim 1 in which each tank end is adjacent a hopper end wall, the means mounting and supporting the tank includes a cradle at about each tank end, and each cradle is supported by means attached to the adjacent hopped end wall.

3. A railroad car according to claim 1 in which the means mounting and supporting the tank includes a cradle, at about each tank end, supported by the side sills.

* * * * *

UNITED STATES PATENT AND TRADEMARK OFFICE

CERTIFICATE OF CORRECTION

PATENT NO. : 4,594,948

DATED : June 17, 1986

INVENTOR(S) : Kenneth H. Smith et al

It is certified that error appears in the above-identified patent and that said Letters Patent is hereby corrected as shown below:

Column 6, line 54, after "railroad" insert -- car --; line 58, change "wall" to -- walls --; line 59, change "still" to -- sill --; line 62, change "still" to -- sill --; column 7, line 1, change "across" to -- access --; line 11, change the first occurence of "of" to -- or --; column 8, line 9, change "hopped" to -- hopper --.

Signed and Sealed this

Ninth Day of September 1986

[SEAL]

Attest:

DONALD J. QUIGG

Attesting Officer

Commissioner of Patents and Trademarks